US007780587B2

(12) United States Patent
Thornton et al.

(10) Patent No.: US 7,780,587 B2
(45) Date of Patent: Aug. 24, 2010

(54) UNWEIGHTING ASSEMBLY AND SUPPORT HARNESS FOR UNWEIGHTING A PATIENT DURING REHABILITATION

(75) Inventors: William N Thornton, Dearborn Heights, IL (US); Chester M. Zuziak, Harrison Township, MI (US)

(73) Assignee: Crawl-To-Walk, LLC, Harrison Township, MI (US)

( * ) Notice: Subject to any disclaimer, the term of this patent is extended or adjusted under 35 U.S.C. 154(b) by 0 days.

(21) Appl. No.: 11/799,137

(22) Filed: May 1, 2007

(65) Prior Publication Data

US 2007/0281842 A1 Dec. 6, 2007

Related U.S. Application Data

(60) Provisional application No. 60/797,517, filed on May 4, 2006.

(51) Int. Cl.
*A63B 26/00* (2006.01)

(52) U.S. Cl. ..... 482/143; 482/69; 119/770

(58) Field of Classification Search ..... 482/121, 482/139, 69, 78, 143; D29/101; 54/6.1; 119/770

See application file for complete search history.

(56) References Cited

U.S. PATENT DOCUMENTS

| | | | | |
|---|---|---|---|---|
| 793,288 | A | 6/1905 | Faber | |
| 2,719,568 | A * | 10/1955 | Webb | 482/68 |
| 4,911,426 | A * | 3/1990 | Scales | 482/69 |
| 5,407,406 | A * | 4/1995 | Canela | 482/51 |
| 6,122,778 | A | 9/2000 | Cohen | |
| 6,367,582 | B1 | 4/2002 | Derby | |
| 6,752,776 | B2 | 6/2004 | West | |
| 6,836,902 | B2 * | 1/2005 | Marquez et al. | 2/69 |
| 6,883,190 | B2 * | 4/2005 | Carbonneau et al. | 5/89.1 |
| 6,942,630 | B2 | 9/2005 | Behan | |
| 2002/0032103 | A1 | 3/2002 | Cook | |
| 2004/0225243 | A1 * | 11/2004 | Leach | 602/19 |

* cited by examiner

*Primary Examiner*—Lori Baker
(74) *Attorney, Agent, or Firm*—Brinks Hofer Gilson & Lione

(57) ABSTRACT

A support harness and an unweighting assembly for at least partially unweighting a patient during rehabilitative exercises. The unweighting assembly including a support harness configured to generally extend around at least a portion of the patient, a support structure for supporting the support harness, and at least three connectors. Each of the connectors includes a first end coupled to the support structure and a second end coupled to the support harness at one of at least three connection points so that the patient is able to be supported in a crawling position.

21 Claims, 8 Drawing Sheets

UNWEIGHTING ASSEMBLY AND SUPPORT HARNESS FOR UNWEIGHTING A PATIENT DURING REHABILITATION

CROSS-REFERENCE TO RELATED APPLICATION

This patent application claims the benefit under 35 U.S.C. §119(e) of U.S. provisional patent application Ser. No. 60/797,517, filed May 4, 2006 and entitled SUPPORT HARNESS FOR UNWEIGHTING A PATIENT DURING REHABILITATION, the entire contents of which is incorporated herein by reference.

BACKGROUND

1. Field of the Invention

The invention relates generally to an unweighting assembly for providing support to a patient during rehabilitative exercises. More specifically, the invention relates to a support harness and a harness assembly for partially or completely unweighting a patient during various stages of rehabilitation.

2. Related Technology

Rehabilitation generally includes two main stages of progression, crawling and walking. During crawling, the patient is obviously in a low position where his/her trunk (defined as the area between the shoulders and the waist) is generally horizontal. During walking, the patient is obviously more upright, with his/her trunk in a generally vertical position.

Currently-known unweighting systems generally include two designs. The first design is a pelvic support system that includes support shorts that encircle the user's pelvis in a manner not unlike a diaper or a pair of shorts and a pair of support straps connected to the support shorts. Each of the support straps is connected to the support shorts at a connection point near the patient's hips, respectively. More specifically, typically the connection points are each located at or near the rear side of one of the patient's hips, between the lower back and the buttocks.

While crawling with a pelvic support system, the forces acting on the patient are primarily or completely concentrated on the patient's pelvis, thereby potentially leading to undesirably stress points that may cause injury or discomfort. Additionally, because the harness only includes two connection points and two support straps, the patient is only supported along a single axis. Therefore, the patient is free to pivot about the axis and may experience difficulty maintaining his/her body in a desired configuration.

For example, while crawling, the patient may have difficulty maintaining his/her torso in a generally horizontal configuration because it is difficult or impossible for the patient to maintain his or her balance. More specifically, if the pelvic support connection points are not positioned such that upper portion of the patient's body, which is positioned in front of the connection points, does not have the same weight as the lower portion of the patient's body, which is positioned behind the connection points, then the patient will tip forwards or backwards. Because different patients have different body sizes and proportions, it may be difficult to position the pelvic support such that the patient is in equilibrium. Additionally, even if the patient is in equilibrium while stationary, it will be nearly impossible for the patient to maintain the equilibrium while crawling. Therefore, the patient will be forced to exert energy supporting him/herself in a generally horizontal position while crawling, thereby reducing the amount of energy that may be used for productive, rehabilitative purposes.

The patient may also experience difficulty maintaining a desired body position while walking in an upright position. For example, because the pelvic support connection points are relatively low along the vertical axis, namely near the patient's hips, the patient will be required to hold his/her upper body in a generally vertical position to avoid flipping forwards or backwards due to moment of inertia forces acting on the patient's upper body about the horizontal axis. In other words, the moment arm between the hips and the patient's upper body is relatively large and causes generally high torque forces if the patient leans slightly forward or backward. As another example, because pelvic support connection points are on the patient's back, they are slightly behind the patient's center of gravity and the patient may be biased forward even if he/she maintains his/her upper body in a generally vertical alignment. Therefore, as with the crawling position, the patient is required to expend energy maintaining a desired body position and is potentially susceptible to falling.

The second design is an over-the-shoulder strap harness that includes two relatively narrow shoulder straps, two relatively narrow crotch straps, and a connector strap portion connecting the respective straps. The harness includes a pair of connection points, one on each shoulder, so that the patient is supported while in an upright position. However, the strap harness design does not include any connection points on the patient's back side and therefore cannot be used to effectively support the patient while he/she is in a crawling position. Furthermore, the crotch straps in this design are relatively thin straps that may cause high stress concentrations on the patient's thighs and/or groin area. The stress concentrations may be especially undesirable in patients having partial or complete paralysis in portions of their body because these patients may be unable to tighten their muscles in the areas of the straps, thereby making their bodies more susceptible to the effects of high stress concentrations.

It is therefore desirable to provide an improved support harness that is able to effectively support a patient while he/she is in a crawling position and in an upright position. Additionally, it is desirable to provide an improved support harness that creates generally even force distribution and avoids relatively high stress concentrations acting on the patient's body.

BRIEF SUMMARY OF THE INVENTION

In one aspect of the present invention, an unweighting assembly for at least partially unweighting a patient during rehabilitative exercises is provided. The unweighting assembly includes a support harness configured to generally extend around at least a portion of the patient, a support structure for supporting the support harness, and at least three connectors. Each of the connectors includes a first end coupled to the support structure and a second end coupled to the support harness at one of at least three connection points so that the patient is able to be supported in a crawling position.

The support structure may include two generally parallel bars and the first end of each of the connectors is slidably coupled with at least one of the bars. Alternatively, the support structure may include a frame and a plurality of rollers coupled with the frame to permit movement of the support structure along a surface. In this design, the frame may include an upper portion and a base portion, wherein the base portion is a generally U-shaped portion supporting each of the rollers.

In another aspect of the invention, a support harness for unweighting a patient during rehabilitative exercises is provided. The support harness includes a harness body having a front side configured to engage a front side of the patient and a back side configured to engage a back side of the patient, and at least three connection points each positioned on or adjacent to the back side of the harness body such that the patient is able to be supported from the connection points in a crawling position. The three connection points may cooperate to generally define a triangle.

The support harness may include at least four connection points positioned on or adjacent to the back side of the harness body such that the patient is able to be supported from the connection points in a crawling position. The connection points may cooperate to generally define a rectangle. Additionally, the four connection points may include first and second connection points each generally aligned with a lower-torso portion of the patient and third and fourth connection points each generally aligned with an upper-torso portion of the patient. The support harness may also include fifth and sixth connection points each generally aligned with a shoulder portion of the patient and seventh and eighth connection points each generally aligned with a mid-torso portion of the patient.

The harness body may include a central portion defining the back side of the harness body, a pair of chest flaps defining the front side of the harness body, a pair of shoulder flaps, and a pair of leg flaps. The chest flaps are able to be secured to each other by a first set of hook-and-loop fasteners, the shoulder flaps are able to be secured to the chest flaps by a second set of hook-and-loop fasteners, and the leg flaps are able to be secured to the chest flaps by a third set of hook-and-loop fasteners.

In yet another aspect of the invention, a support harness for unweighting a patient during rehabilitative exercises is provided. The support harness includes a harness body configured to generally extend around at least a portion of the patient and a plurality of connection points coupled with the harness body, including a first group of connection points from which the patient is able to be supported in a generally vertical position and a second group of connection points from which the patient is able to be supported in a generally horizontal position.

In another aspect of the invention, a support harness for unweighting a patient during rehabilitative exercises is provided. The support harness includes an upper portion configured to at least extend generally around an upper torso of the patient, a lower portion configured to at least extend generally around a lower torso of the patient, and a coupling mechanism for selectively coupling the upper portion and the lower portion with each other.

DETAILED DESCRIPTION

Figure 1:
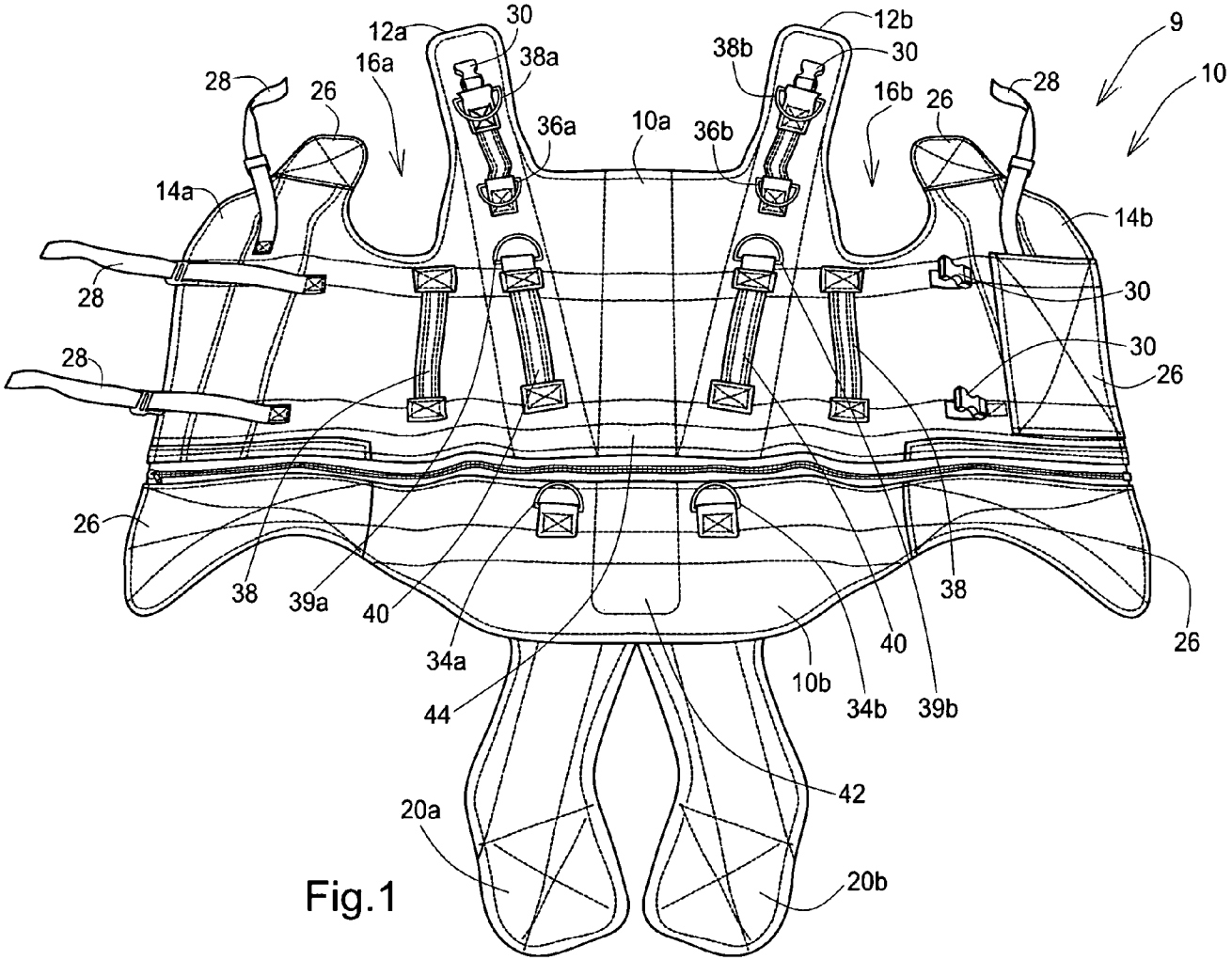
FIG. 1 is a top view of a support harness embodying the principles of the present invention and utilized for unweighting a patient during rehabilitative exercises, where the support harness is in an open configuration.
Figure 2:
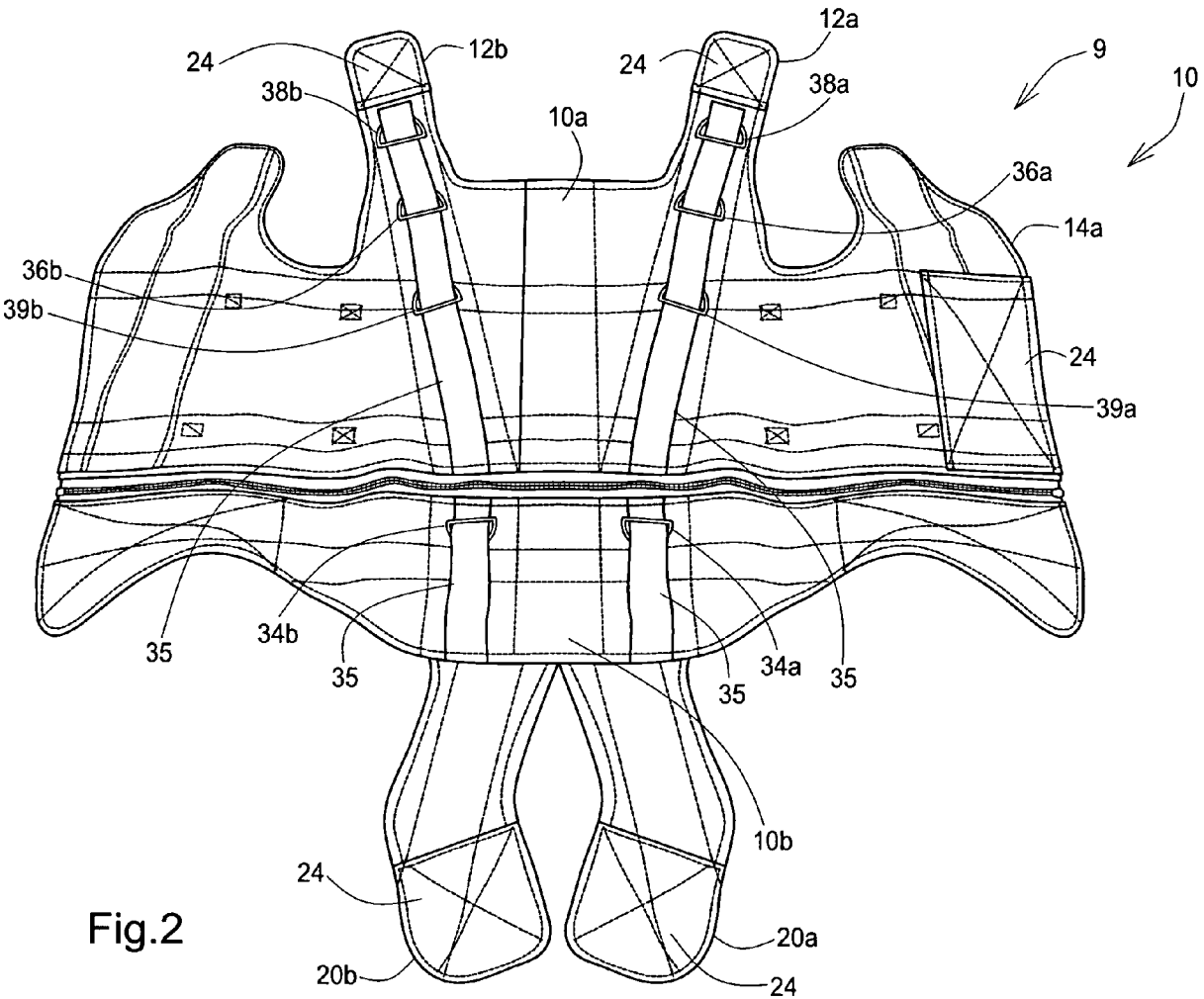
FIG. 2 is a bottom view of a support harness shown in FIG. 1.

Referring now to the present invention, FIGS. 1 and 2 show a support harness 9 for unweighting a patient during rehabilitative exercises, where FIG. 1 shows the exterior surface of the support harness 9 and FIG. 2 shows the inner surface of the support harness 9. The support harness 9 includes a harness body 10 that generally fits substantially completely around the patient's trunk (which is defined herein as the portion of the patient's body extending from the shoulders to the buttocks, not including the arms). This configuration provides robust support for the patient so as to avoid high stress concentrations on the patient's body. The harness body includes an upper portion 10*a* configured to support the patient's torso region and a lower portion 10*b* configured to support the patient's crotch region.

The harness body 10 includes a pair of shoulder flaps 12*a*, 12*b* that each wrap over the patient's respective shoulders and are secured to chest flaps 14*a*, 14*b* via an appropriate fastening mechanism. For example, a hook-and-loop fastener such as Velcro may be used, straps, or other fastening means may be used. The shoulder and chest flaps 12, 14 cooperate to define arm openings 16*a*, 16*b*. The torso shoulder flaps 12*a*, 12*b* cooperate with the chest flaps 14*a*, 14*b* to wrap snugly around the patient's shoulder region, in a manner so that he/she is secure within the harness body 10 while maintaining a wide range of motion with his/her arms. Therefore, the size of the arm openings 16*a*, 16*b* can be adjusted by adjusting the overlap position of the respective shoulder flaps 12 on the chest flaps 14. For example, the harness body 10 shown in the figures includes a plurality of male Velcro patches 24 and female Velcro patches 26 that cooperate with each other to form secure connections. More specifically, the shoulder flaps 12*a*, 12*b* each include male Velcro patches 24 (best shown in FIG. 2) that are secured to female Velcro patches 26 on the chest flaps 14 (best shown in FIG. 1). Additionally, auxiliary straps 28 and auxiliary buckles 30 are coupled with each other to reinforce the Velcro connection in the shoulder region.

In addition to engaging the shoulder flaps 12*a*, 12*b*, the chest flaps 14*a*, 14*b* also engage each other. More specifically, the chest flaps 14*a*, 14*b* each wrap around the patient's torso and are secured together via an appropriate fastening mechanism. The chest flaps 14*a*, 14*b* cooperate with each other to wrap snugly around the patient's torso, in a manner so that he/she is secure within the harness body 10 while still being able to fully expand his/her lungs. Therefore, the effective diameter of the torso region of the harness body 10 can be adjusted by adjusting the overlap distance of the chest flaps 14*a*, 14*b*. For example, the harness body 10 includes a male Velcro patch 24 on one chest flap 14*b* (best shown in FIG. 2) and a female Velcro patch 26 on the other chest flap 14*a* (best shown in FIG. 1). Additionally, auxiliary straps 28 and auxiliary buckles 30 are coupled with each other to reinforce the Velcro connection in the torso region.

The harness body 10 also include a pair of leg flaps 20*a*, 20*b* that each wrap across the patient's buttocks region, through his/her legs, and upwards to his/her lap region where the leg flaps 20*a*, 20*b* are secured to chest flaps 14*a*, 14*b* of the harness body 10. The leg flaps 20*a*, 20*b* cooperate with the chest flaps 14*a*, 14*b* to wrap snugly around the patient's crotch area, in a manner so that he/she is secure within the harness body 10. Therefore, the effective size of the crotch region of the harness body 10 can be adjusted by adjusting the overlap distance of the leg flaps 20 on the chest flaps 14. For example, the harness body 10 includes a male Velcro patch 24 on each of the leg flaps 20*a*, 20*b* (best shown in FIG. 2) and a female Velcro patch 26 on each of the lap portions 22*a*, 22*b* (best shown in FIG. 1).

As shown in the figures, the shoulder flaps 12 and leg flaps 20 are each substantially wider than those used in the currently-known devices. More specifically, the shoulder straps 12 each extend completely across the width of the patient's shoulder and the leg flaps 20 cooperate to extend completely across the distance between the patient's thighs. This design reduces discomfort and stress concentrations experienced by the patient.

The patient is preferably secured within the harness body 10 via the following method. First, the harness 10 is spread onto a flat surface, such as a tabletop or the floor, so that the exterior side of the harness (which is shown in FIG. 1) contacts the flat surface. Next, the patient is positioned so that his/her back is generally centered on the inner side of the harness 10 (which is visible in FIG. 2), with his/her head between the shoulder flaps 12*a*, 12*b* and his/her legs spread apart with the leg flaps 20*a*, 20*b* aligned with the gap between his/her legs. The first chest flap 14*a* is wrapped around the patient's torso and the second chest flap 14*b* is likewise wrapped around the patient's torso so that it is secured to the first chest flap 14*a* via the Velcro patches 24, 26. As discussed above, the overlap distance between the chest flaps 14*a*, 14*b* determines the effective size of the torso region, and therefore the size of the torso region may be adjusted accordingly.

Next, the leg flaps 20*a*, 20*b* are each wrapped across the patient's buttocks region, through his/her legs, and upwards to his/her lap region so that they are secured to the chest flaps 14*a*, 14*b*, respectively, via the Velcro patches 24, 26. As discussed above, the overlap distance between the leg flaps 20*a*, 20*b* and the chest flaps 14*a*, 14*b* determines the effective size of the crotch region and therefore the size of the crotch region may be adjusted accordingly.

Next, the shoulder flaps 12*a*, 12*b* are then wrapped over the patient's shoulders and respectively secured to the chest flaps 14*a*, 14*b*, respectively, via the Velcro patches 24, 26. As discussed above, the overlap distance between the shoulder flaps 12*a*, 12*b* and the chest flaps 14*a*, 14*b* determines the effective size of the shoulder region and therefore the size of the shoulder region may be adjusted accordingly. All of the straps 28 are then secured to the buckles 30 to reinforce the Velcro connections.

The support harness 9 also includes connection points for connecting the support harness 9 to a support assembly and unweighting the patient. The connection points are positioned with respect to the harness body 10 so that the patient can be effectively supported while being unweighted in both a crawling position and in a walking position.

Figure 3:
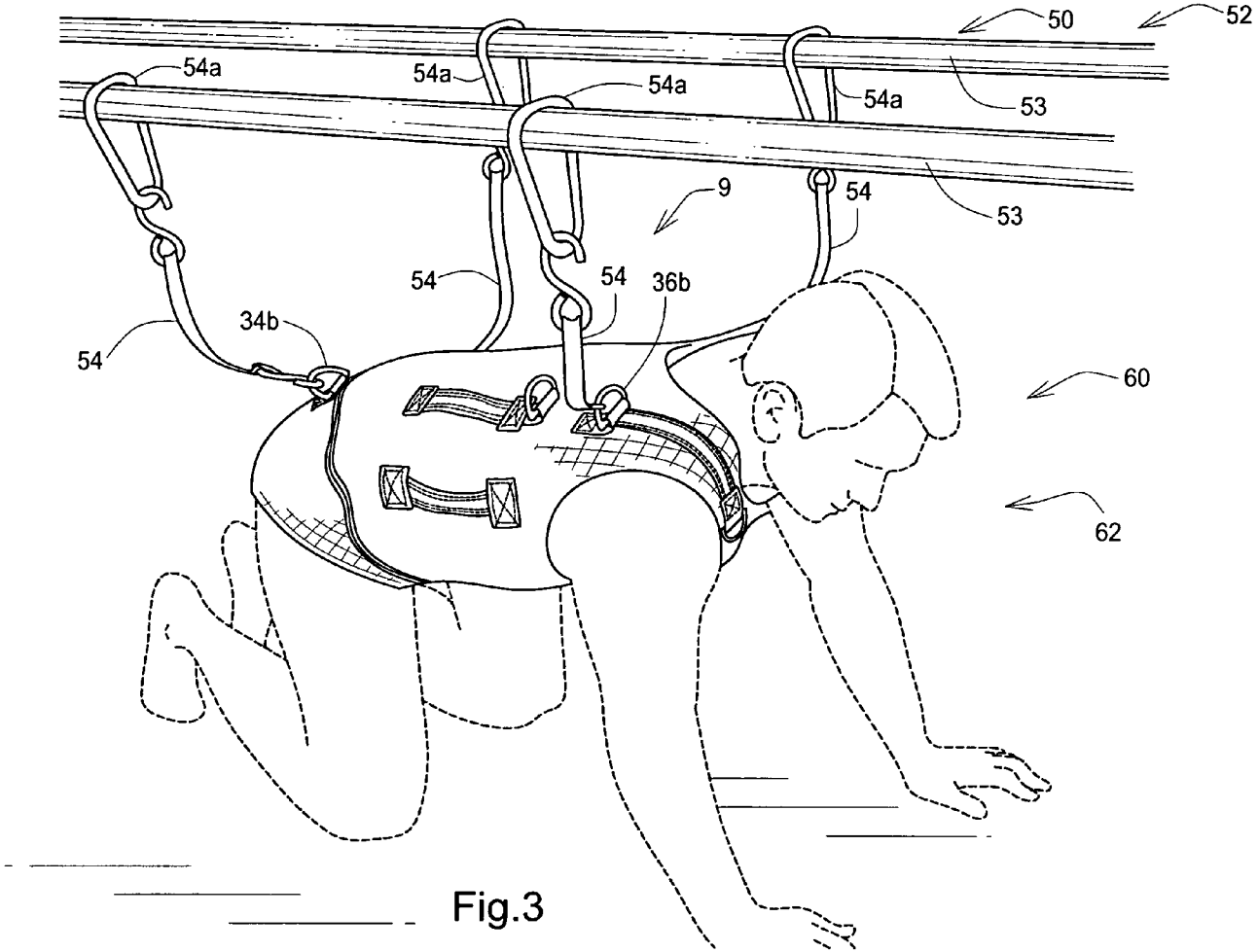
FIG. 3 is an isometric view of a harness assembly embodying the principles of the present invention, where a patient is shown in a crawling position utilizing the harness assembly.

The connection points for supporting the patient in a crawling position are preferably positioned on or adjacent to the back side of the harness body such that the patient is able to be supported from the connection points in a crawling position. As used herein, the term "back side of the harness body" includes any portion of the support harness facing generally upward when the patient is in a crawling position as shown in FIG. 3. For example, first and second connection points 34*a*, 34*b* are generally aligned with the patient's lower torso, more specifically the patient's hips, and third and fourth connection points 36*a*, 36*b* are generally aligned with the patient's upper torso, more specifically the patient's shoulder blades. As shown in FIGS. 1 and 2, the connection points 34*a*, 34*b*, 36*a*, 36*b* each include rings that are secured to the harness body 10 via any appropriate means. The rings are preferably relatively strong metal rings that are secured to the harness body 10 via any appropriate connection. More specifically, the rings are preferably D-shaped rings, where the flat sides of the rings are secured to the harness body 10 and the arcuate sides are connected to the unweighting components. As shown in FIG. 2, the rings each extend through openings in the harness body 10 such as to encircle a strip of reinforcement material 35. Therefore, during use, when a force pulls the arcuate side of a ring away from the harness body 10, the flat side of the tightly engages the reinforcement material 35 and is prevented from ripping through the openings in the harness body 10.

The connection points for supporting the patient in a walking position preferably include fifth and sixth connection points 38*a*, 38*b* generally aligned with the patient's upper shoulders, more specifically the patient's clavicles. As shown in FIGS. 1 and 2, the fifth and sixth connection points 38*a*, 38*b* include relatively strong metal, D-shaped rings that are similar or the same as the rings discussed above with respect to connection points 34*a*, 34*b*, 36*a*, 36*b*.

The support harness 9 shown in FIGS. 1 and 2 further includes additional connection points positioned on the back side of the harness body 10 for supporting the patient in a crawling position. More specifically, seventh and eighth connection points 39*a*, 39*b* are generally aligned with the patient's mid-torso, more specifically the patient's ribs. The seventh and eighth connection points 39*a*, 39*b* may be utilized instead of, or in addition to, the third and fourth connection points 36*a*, 36*b* depending on the weight, size, and shape of the patient.

The respective connection points and postural adjustments (thoracic and lumbar) allow for manipulation of an individuals trunk in the frontal, sagittal, and transverse planes alone or in combination during both crawling and upright supported walking.

The harness body 10 also preferably includes a handles 38, 40 for assisting the patient with a standing movement. More specifically, the harness body 10 preferably includes a pair of back handles 40 and a pair of side handles 38 so that a trainer or other medical personnel can help lift the patient from a seated position to a standing position. Alternatively, the handles may be used for any other suitable use, such as steadying a patient during other exercises or types of movement.

The harness body 10 preferably includes a lumbar support pocket 42 aligned with the patient's lower back for anterior/posterior pelvis positioning during crawling and upright supported gait training. The harness body 10 also preferably includes a pair of dorsal thoracic postural correction strap 44 that allows for correction or reduction of kyphosis and or scoliosis during both crawling and upright supported gait training.

The harness body 10 is separable into the upper portion 10*a* and the lower portion 10*b* by a coupling mechanism, such as a zipper 46. Therefore, depending on whether the patient is in a walking or a crawling position, the harness body 10 can be separated into the respective portions so that only one portion is utilized. For example, the lower component may be used alone, or in conjunction with the upper component, during crawling sessions. Similarly, the upper component may be used alone, or in conjunction with the lower component, during crawling sessions. This configuration adds to the versatility of the support harness 9, while potentially reducing overall size thereof.

Figure 4:
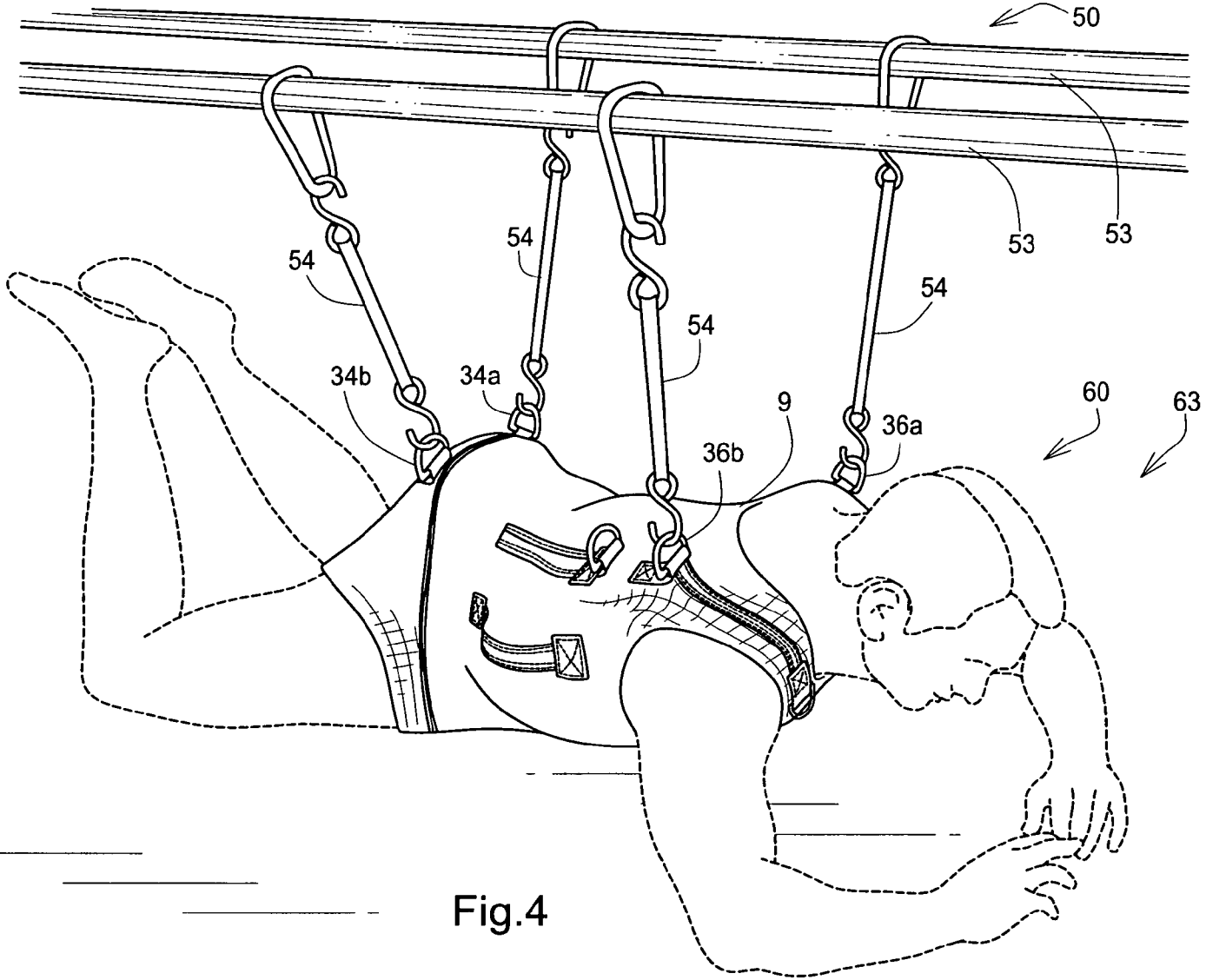
FIG. 4 is an isometric view of the harness assembly shown in FIG. 3, where the patient is in a suspended position.

Referring to FIGS. 3 and 4, a harness assembly 50 is shown, including a support structure 52, the support harness 9, and a plurality of support straps 54 extending between the support harness 9 and the support structure 52.

The support structure 52 shown in FIGS. 3 and 4 is a self-standing frame having generally horizontal beams 53 extending generally parallel to each other. Additionally, the height of the horizontal beams 53 is preferably adjustable so that the support structure 52 can be utilized both with a crawling and a walking patient. The support straps 54 each include a first end 54*a* connected to the support structure 52 and a second end 54*b* connected to the support harness 9. The first end 54*a* of each of the support straps 54 includes a relatively large hook for slidably connecting to the support structure 52 and the second end 54*b* of each of the support straps 54 includes a relatively small hook for connecting to the support harness rings. Alternatively, any other appropriate fasteners may be used. Although the support structure 52 shown in the figures includes generally linear horizontal beams 53, an alternative design may include beams that define a continuous path, such as an oval or a circular shaped path so that the patient can continuously exercise.

In the crawling position, the harness is supported by at least three connection points that are not all along a single line so that the harness assembly is prevented from undesirably pivoting about an axis. The three connection points cooperate to define a triangle. This configuration permits the physical therapist to secure the patient within a desired plane (typically such that the patient's trunk is horizontal) and the patient will remain within the plane without any additional effort. More specifically, the harness preferably includes four connection points that are generally adjacent to the four corners of the patient's trunk to provide maximum stability of the shoulders, trunk, and hips during crawling/creeping/walking.

As shown in FIG. 3, where the patient 60 is in a crawling position 62, the first and second connection points 34*a*, 34*b* near the patients hips and the third and fourth connection points 36*a*, 36*b* cooperate to support the patient 60 such that his torso region is generally horizontal and his weight is spread generally evenly across the length of this trunk. This configuration provides support for the patient while permitting a natural crawling position. Additionally, the respective connection points and postural adjustments (thoracic and lumbar) allow for manipulation of an individuals trunk in the frontal, sagittal, and transverse planes alone or in combination during both crawling the crawling position.

As shown in FIG. 4, where the patient 60 is in a suspended position 63, the first and second connection points 34*a*, 34*b* near the patients hips and the third and fourth connection points 36*a*, 36*b* cooperate to support the patient 60 such that his torso region is generally horizontal and his weight is spread generally evenly across the length of this trunk. This configuration provides support for the patient and potentially reduces stress points acting on the patient's body.

Figure 5:
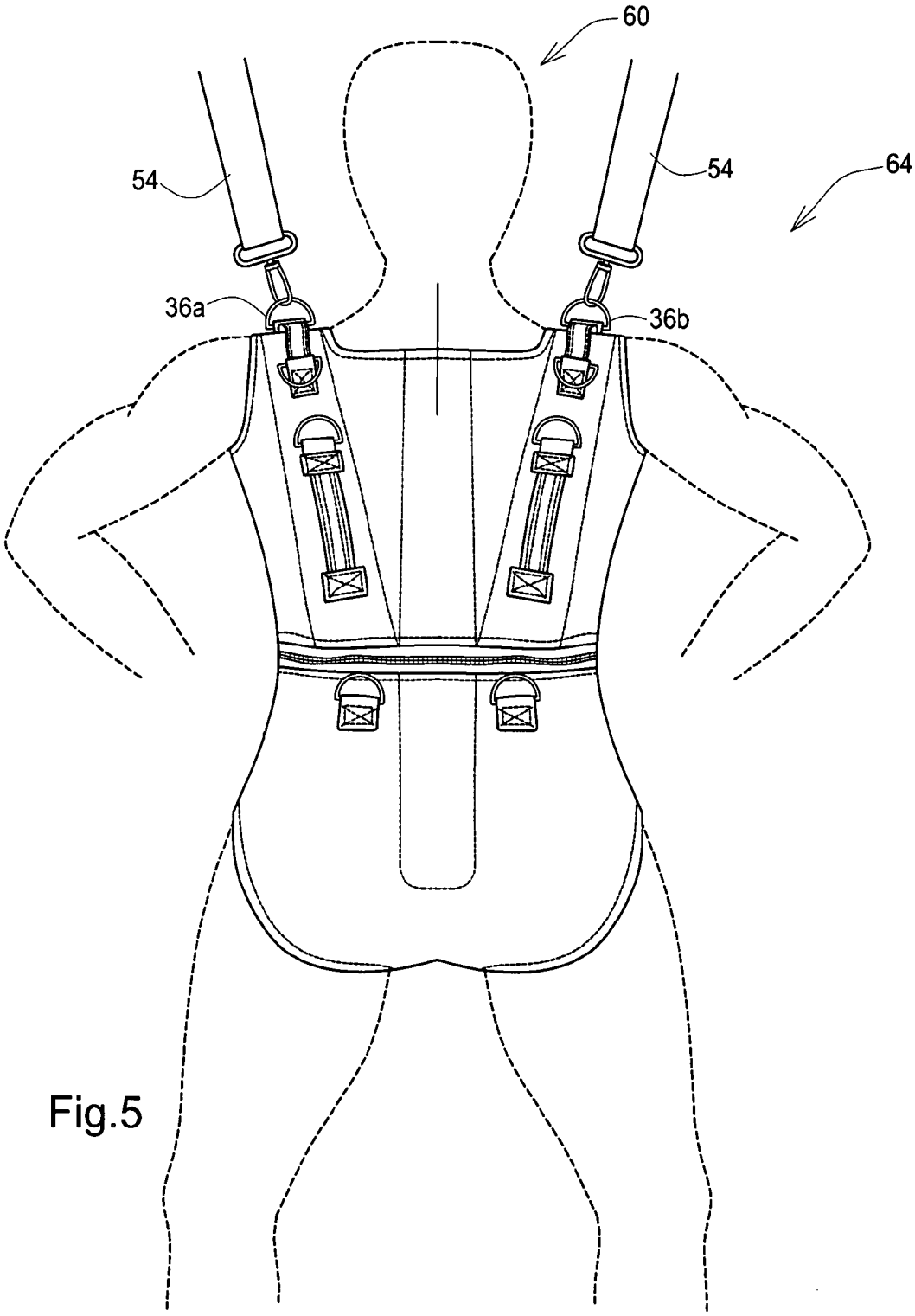
FIG. 5 is a rear view of the support harness shown in FIG. 1, where the patient is utilizing the support harness in a walking position.

As shown in FIG. 5, the patient 60 is shown in a walking position 64 where he is supported by the shoulder rings 36*a*, 36*b* so that the patient is supported in a natural, upright position. More specifically, the patient 60 is generally vertical when in the walking position 64.

Figure 6:
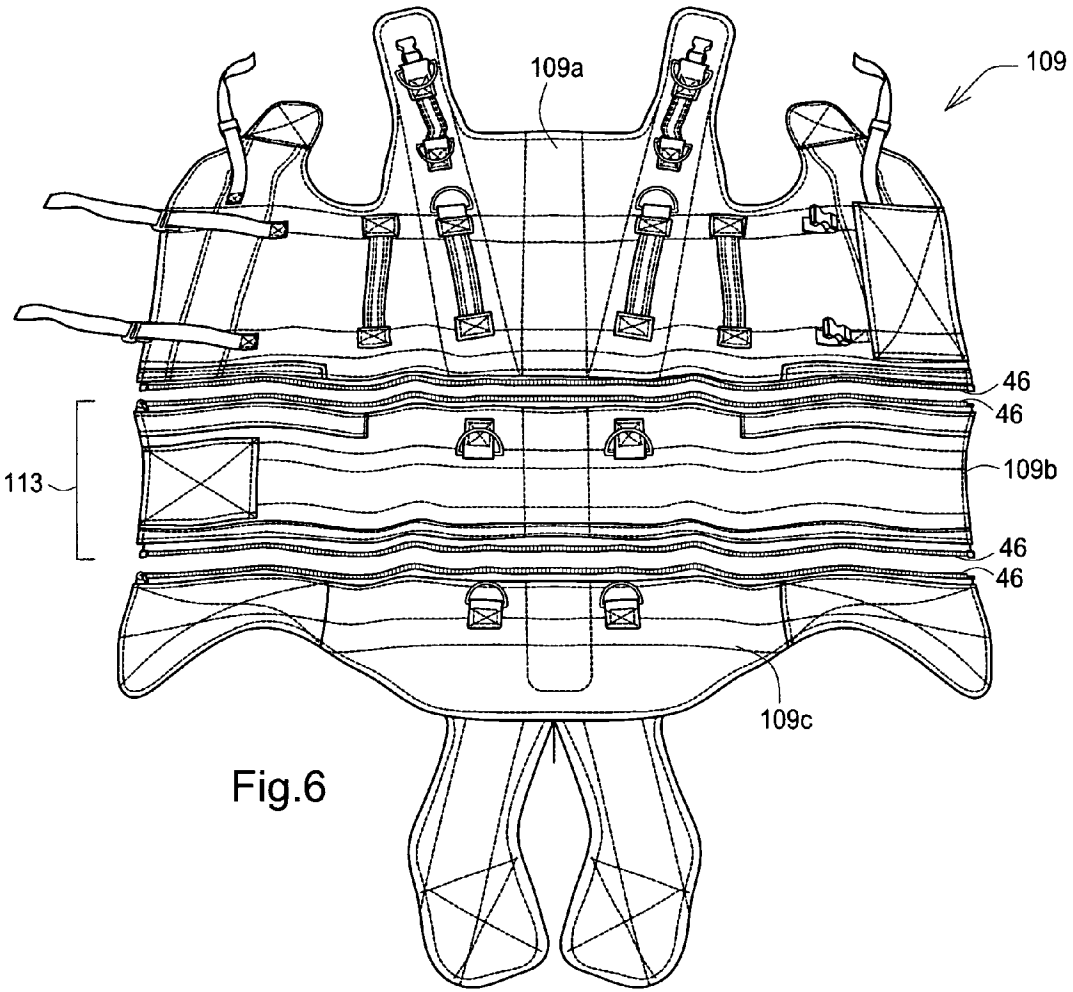
FIG. 6 is a top view of another support harness embodying the principles of the present invention and utilized for unweighting a patient during rehabilitative exercises.

As shown in FIG. 6, an alternative design, the support harness 109 includes an upper portion 109*a* for extending generally around the upper torso of the patient, a middle portion 109*b* for extending generally around the middle torso of the patient, and a lower portion 109*c* for extending generally around the lower torso of the patient. The respective portions 109*a*, 109*b*, 109*c* are selectively coupled with each other by a coupling mechanism such as a zipper 46. The support harness 109 may include the middle portion 109*b* for use with relatively tall patients and may not include the middle portion 109*b* for use with shorter patients. Additionally, the support harness 109 may be provided with several middle portions 109*b* of varying length 113.

Figure 7:
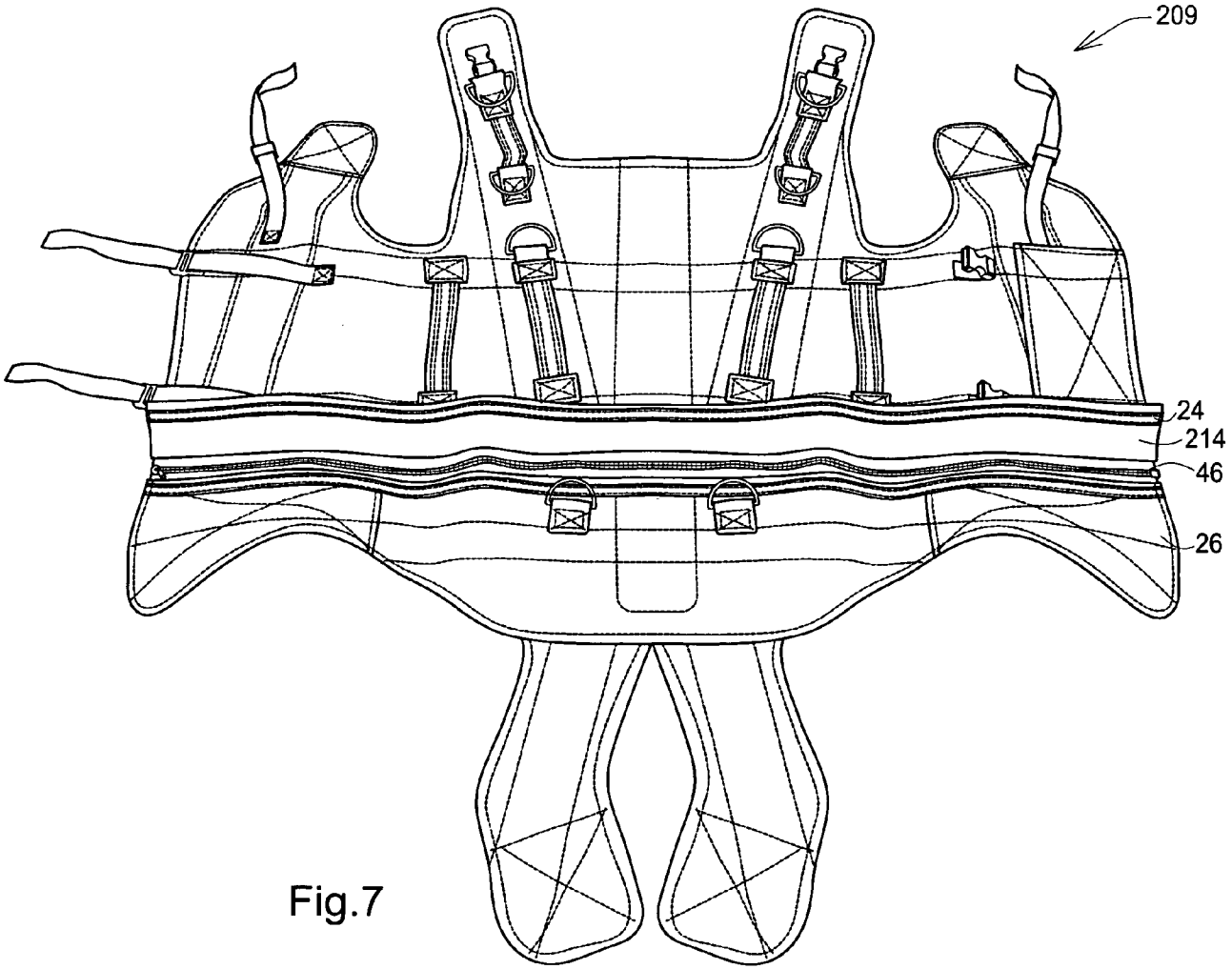
FIG. 7 is a top view of yet another support harness embodying the principles of the present invention and utilized for unweighting a patient during rehabilitative exercises.

As shown in FIG. 7, another alternative design, the support harness 209 includes a flap 214 that selectively covers a zipper 46 to prevent accidental unzipping and to improve the overall aesthetics of the support harness 209. The flap 214 is connected to the upper portion 209*a* of the support harness 209 and is selectively coupled with the lower portion 209*b* via Velcro patches 24, 26 extending along the length of the zipper 46.

Figure 8:
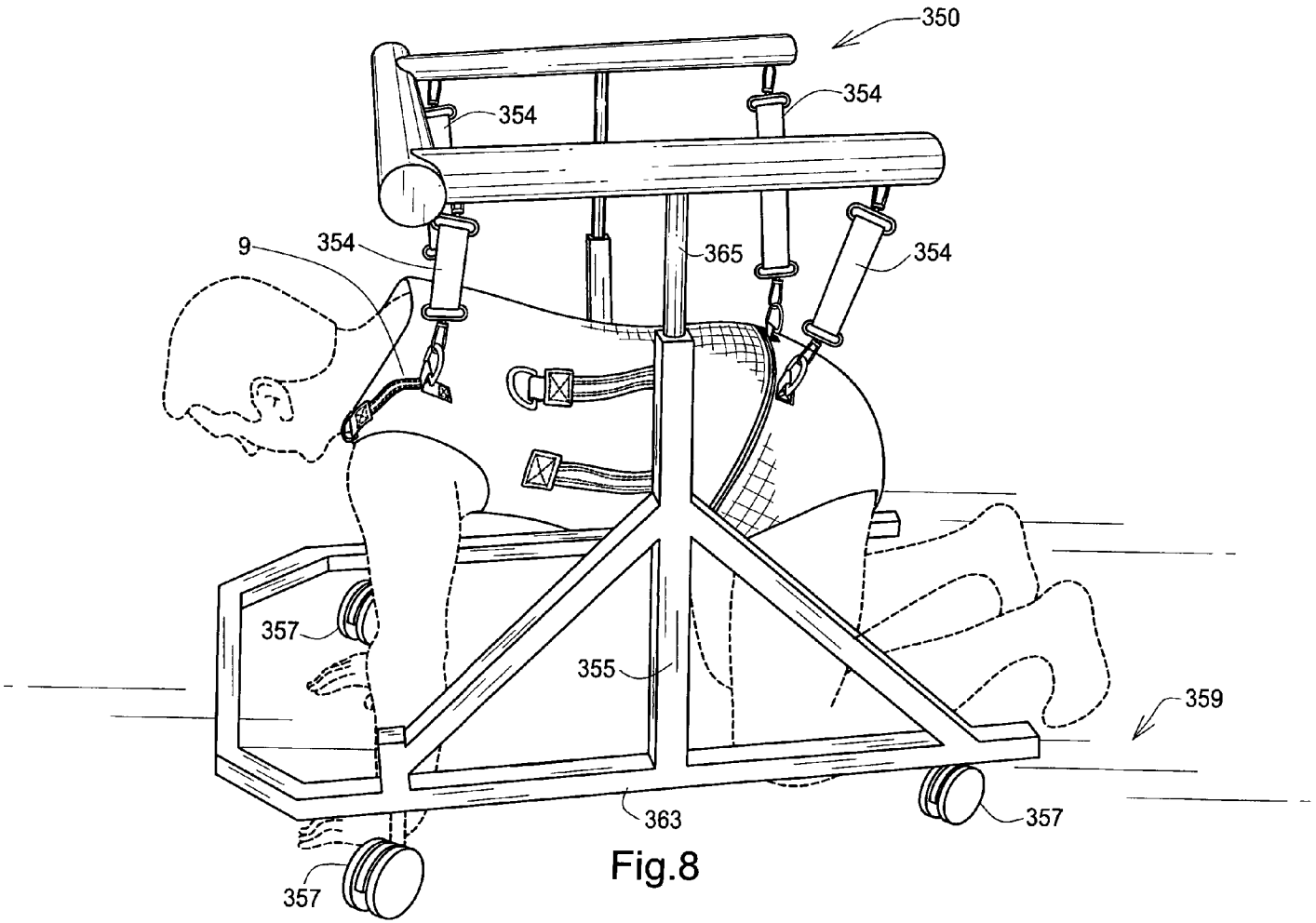
FIG. 8 is an isometric view of another harness assembly embodying the principles of the present invention.

As shown in FIG. 8, yet another alternative design, an unweighting assembly is shown 350, including the support harness 9, a support structure 352 for supporting the support harness 9, and connectors 354 connecting the support harness 9 to the support structure 352. The support structure 352 includes a frame 355 and a plurality of rollers 357 coupled with the frame 355 to permit movement of the support structure 352 along a surface 359. The frame 355 includes an upper portion 361 for supporting the connectors 354 and a base portion 363 connected to the upper portion 361 by vertical supports 365. The upper portion 361 is generally U-shaped to provide even support for the patient and to provide the patient with easy access to the space within the base portion 363. Similarly, the base portion 363 is also U-shaped. The rollers 357 permit the patient to move along the surface 359 in an endless path. Additionally, the height of the vertical supports 365 is adjustable.

In an alternative design, however, each of the connection points may include a removable connector that can be easily and quickly moved from one strap loop to another, rather than the D-rings discussed above which are fixedly connected to the support harness. This alternative design reduces the total number of connectors that are necessary, since all six connection points are typically not all utilized at once.

The harness 10 may be made of any appropriate material, such as two canvas layers having a foam material therebetween. Alternatively, all or a portion of the harness is made of a buoyant material to help unweighting of the patient while in a body of water. The zipper 46 is preferably a heavy duty zipper or any other suitable connector. The harness 10 preferably includes both industrial strength Velcro and adjustable straps for securing the patient within the harness. The straps supporting the D-rings are preferably made of a seat belt material and they may be reinforced with sail tape that is located between the canvas layers.

It is therefore intended that the foregoing detailed description be regarded as illustrative rather than limiting, and that it be understood that it is the following claims, including all equivalents, that are intended to define the spirit and scope of this invention.

What is claimed is:

1. An unweighting assembly for at least partially unweighting a patient during rehabilitative exercises, the unweighting assembly including:

a support harness configured to generally extend around at least a portion of the patient, the support harness having at least three connection points;

a support structure for supporting the support harness having at least two parallel bars;

and at least three connectors, each of the connectors having a first end slidably coupled to the support structure and a second end coupled to the support harness at one of the at least three connection points;

wherein at least one of the connection points is proximate to a lower-torso portion of the patient and at least another of the connection points is proximate to an upper-torso portion of the patient such that the patient is able to be supported in a crawling position while the support harness is coupled with the support structure.

2. An unweighting assembly as in claim 1, wherein the support structure includes two generally parallel bars and the first end of each of the connectors is slidably coupled with at least one of the bars.

3. An unweighting assembly as in claim 2, wherein the support harness includes at least four connection points and the unweighting assembly includes at least four connectors, wherein two of the connectors are slidably coupled with one of the bars and two of the connectors are slidably coupled with another one of the bars.

4. An unweighting assembly as in claim 1, wherein the support structure includes a frame and a plurality of rollers coupled with the frame to permit movement of the support structure along a surface.

5. An unweighting assembly as in claim 4, wherein the frame includes an upper portion and a base portion, wherein each of the connectors is coupled to the upper portion of the frame, and wherein the base portion is a generally U-shaped portion supporting each of the plurality of rollers.

6. A support harness for unweighting a patient during rehabilitative exercises, the support harness including:

a harness body configured to generally extend around at least a portion of the patient, the harness body having a front side configured to engage a front side of the patient and a back side configured to engage a back side of the patient;

and at least three connection points each positioned on or adjacent to the back side of the harness body, at least one chest flap, at least one shoulder flap, at least one leg flap, wherein at least one of the connection points is proximate to a lower-torso portion of the patient and at least another of the connection points is proximate to an upper-torso portion of the patient such that the patient is able to be supported from the connection points in a crawling position while the support harness is slidably coupled with a support structure having at least two parallel bars.

7. A support harness as in claim 6, wherein the at least three connection points cooperate to generally define a triangle.

8. A support harness as in claim 6, wherein the support harness includes at least four connection points each positioned on or adjacent to the back side of the harness body such that the patient is able to be supported from the connection points in a crawling position.

9. A support harness as in claim 8, wherein the at least four connection points cooperate to generally define a rectangle.

10. A support harness as in claim 8, wherein the at least four connection points include first and second connection points each generally aligned with the lower-torso portion of the patient and third and fourth connection points each generally aligned with the upper-torso portion of the patient.

11. A support harness as in claim 10, wherein the support harness includes fifth and sixth connection points each generally aligned with a shoulder portion of the patient.

12. A support harness as in claim 11, wherein the support harness includes seventh and eighth connection points each generally aligned with a mid-torso portion of the patient.

13. A support harness as in claim 12, wherein the connection points are defined by D-shaped metal rings each coupled to the harness body.

14. A support harness as in claim 6, wherein the harness body includes a central portion defining the back side of the harness body, a pair of chest flaps defining the front side of the harness body, a pair of shoulder flaps, and a pair of leg flaps.

15. A support harness as in claim 14, wherein the chest flaps are able to be secured to each other by a first set of hook-and-loop fasteners, the shoulder flaps are able to be secured to the chest flaps by a second set of hook-and-loop fasteners, and the leg flaps are able to be secured to the chest flaps by a third set of hook-and-loop fasteners.

16. A support harness a in claim 6, wherein the harness body includes a plurality of grip handles for lifting the support harness.

17. A support harness for unweighting a patient during rehabilitative exercises, the support harness including:

a harness body configured to generally extend around at least a portion of the patient;

a support structure having at least two parallel bars, and a plurality of connection points coupled with the harness body, including a first group of connection points from which the patient is supported in a generally vertical position while the support harness is coupled with a support structure and a second group of connection points from which the patient is supported in a generally horizontal position while the support harness is slidably coupled with said support structure.

18. A support harness as in claim 17, wherein the first group of connection points includes first and second connection points each generally aligned with a lower torso portion of the patient and third and fourth connection points each generally aligned with an upper torso portion of the patient.

19. A support harness as in claim 18, wherein the second group of connection points includes fifth and sixth connection points each generally aligned with a shoulder portion of the patient.

20. A support harness for unweighting a patient during rehabilitative exercises, the support harness including:

a support structure having at least two parallel bars, an upper portion configured to at least extend generally around an upper torso of the patient;

a lower portion configured to at least extend generally around a lower torso of the patient;

a coupling mechanism for selectively coupling the upper portion and the lower portion with each other; and at least three connection points, wherein at least one of the connection points is positioned on or adjacent to the upper portion and at least one of the connection points is positioned on or adjacent to the lower portion such that the patient is supported from the connection points in a crawling position while the support harness is slidably coupled with said support structure.

21. A support harness as in claim 20, further comprising a middle portion configured to at least extend generally around a lower torso of the patient and a second coupling mechanism for selectively coupling the middle portion to the upper portion and to the lower portion.

* * * * *

UNITED STATES PATENT AND TRADEMARK OFFICE

CERTIFICATE OF CORRECTION

PATENT NO. : 7,780,587 B2
APPLICATION NO. : 11/799137
DATED : August 24, 2010
INVENTOR(S) : William N. Thornton et al.

It is certified that error appears in the above-identified patent and that said Letters Patent is hereby corrected as shown below:

In the Claims

In column 10, claim 16, line 17, after "A support harness" replace "a" with --as--.

In column 10, claim 17, line 24, immediately after "two parallel bars" replace "," with --;--.

In column 10, claim 20, line 44, immediately after "two parallel bars" replace "," with --;--.

Signed and Sealed this
Twenty-fifth Day of January, 2011

David J. Kappos

David J. Kappos
*Director of the United States Patent and Trademark Office*